US006769397B2

(12) United States Patent
Katou et al.

(10) Patent No.: US 6,769,397 B2
(45) Date of Patent: Aug. 3, 2004

(54) INTAKE APPARATUS AND METHODS OF INTERNAL COMBUSTION ENGINE

(75) Inventors: Yuuichi Katou, Susono (JP); Hiroki Ichinose, Fujinomiya (JP); Atsushi Ito, Anjo (JP); Motonobu Hasegawa, Kariya (JP)

(73) Assignees: Toyota Jidosha Kabushiki Kaisha, Toyota (JP); Aisin Seiki Kabushiki Kaisha, Kariya (JP)

( * ) Notice: Subject to any disclaimer, the term of this patent is extended or adjusted under 35 U.S.C. 154(b) by 99 days.

(21) Appl. No.: 10/122,339

(22) Filed: Apr. 16, 2002

(65) Prior Publication Data

US 2002/0148437 A1 Oct. 17, 2002

(30) Foreign Application Priority Data

Apr. 17, 2001 (JP) ..... 2001-118515

(51) Int. Cl.[7] ..... F02D 9/08
(52) U.S. Cl. ..... 123/337; 123/399; 137/15.18
(58) Field of Search ..... 123/337, 399; 251/305

(56) References Cited

U.S. PATENT DOCUMENTS

| | | | | | |
|---|---|---|---|---|---|
| 5,720,255 | A | * | 2/1998 | Yoshikawa | 123/337 |
| 5,806,484 | A | * | 9/1998 | Yoneyama et al. | 123/308 |
| 6,520,198 | B1 | * | 2/2003 | Nishijima et al. | 137/15.18 |
| 2003/0101966 | A1 | * | 6/2003 | Hatttori et al. | 123/337 |

FOREIGN PATENT DOCUMENTS

| | | |
|---|---|---|
| JP | 6-248959 | 9/1994 |
| JP | 7-38665 | 7/1995 |

* cited by examiner

*Primary Examiner*—Thomas N. Moulis
(74) *Attorney, Agent, or Firm*—Oliff & Berridge, PLC

(57) ABSTRACT

An intake apparatus and methods of an internal combustion engine that controls an intake air current to the combustion engine. An intake current control valve has an open portion for passing intake currents, and has an external shape that has at least four corner portions corresponding to a shape of an intake pipe. Precise control of the amount of intake air can be accomplished if the open portion is closed, and then the amount of air leaking via the periphery of the valve is measured.

22 Claims, 7 Drawing Sheets

INTAKE APPARATUS AND METHODS OF INTERNAL COMBUSTION ENGINE

The disclosure of Japanese Patent Application No. 2001-118515 filed on Apr. 17, 2001 including the specification, drawings and abstract is incorporated herein by reference in its entirety.

BACKGROUND OF THE INVENTION

1. Field of Invention

The invention relates to an intake apparatus and methods of an internal combustion engine that controls an air current formed in a combustion chamber by controlling the opening and closing of an intake current control valve that is positioned downstream of a throttle valve in an intake pipe.

2. Description of Related Art

As a related technology, Japanese Patent Application Laid-Open No. 6-248959 discloses an intake apparatus of an internal combustion engine where an intake current control valve is positioned in an intake pipe downstream of the throttle valve and upstream of the fuel injection apparatus.

This intake apparatus incorporates a swirl control valve (intake current control valve) positioned in an intermediate portion of the intake passage, and produces intake air swirls by closing a swirl control valve body that has a cutout. The apparatus thereby increases the combustion speed, improves the rate of fuel consumption during a low-load operation and stabilizes the engine revolution during a lean air-fuel ratio operation.

With regard to using the control valve as discussed above, various configurations have been proposed. In order to form a stable air current during closure of the control valve, it is necessary to precisely set the area and position of a constricted portion of the intake pipe that is formed by closing the valve. However, with the control valve configurations of the related technologies, it is difficult to control the amount of intake air leaking through a gap between an outer periphery of the valve and an interior wall portion of the intake pipe.

Furthermore, in order to reduce the gap between the outer periphery of the valve and the interior wall portion of the intake pipe for the purpose of reducing the leakage of air through the gap therebetween, it becomes necessary to mount the valve in the intake pipe with high precision. If the gap is reduced, but a necessary precision in mounting the valve to the intake pipe is not obtained, the valve may contact the interior wall of the intake pipe and cause damage. Moreover, the valve may become stuck in the intake pipe and, subsequently, cannot be opened or closed. As a result, the internal combustion engine equipped with the control valve fails to achieve stable combustion, thereby degrading the emission characteristic and drivability of the vehicle incorporating the internal combustion engine.

SUMMARY OF THE INVENTION

Accordingly, it is an object of the invention to provide an intake apparatus of an internal combustion engine equipped with an intake control valve which is capable of producing air currents with stability by controlling the air leakage that occurs through a gap between an outer periphery of the valve and an interior wall portion of the intake pipe during closure of the valve.

More specifically, the intake control valve is disposed upstream of the combustion chamber in an intake pipe that leads an intake air current into a combustion chamber, and that has a section that intersects a longitudinal axis of the intake pipe. The intake control valve controls an air current to a combustion chamber through the opening and closing of the valve. Furthermore, the intake control valve has an open portion for passing intake currents only through the open portion in the closed state.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
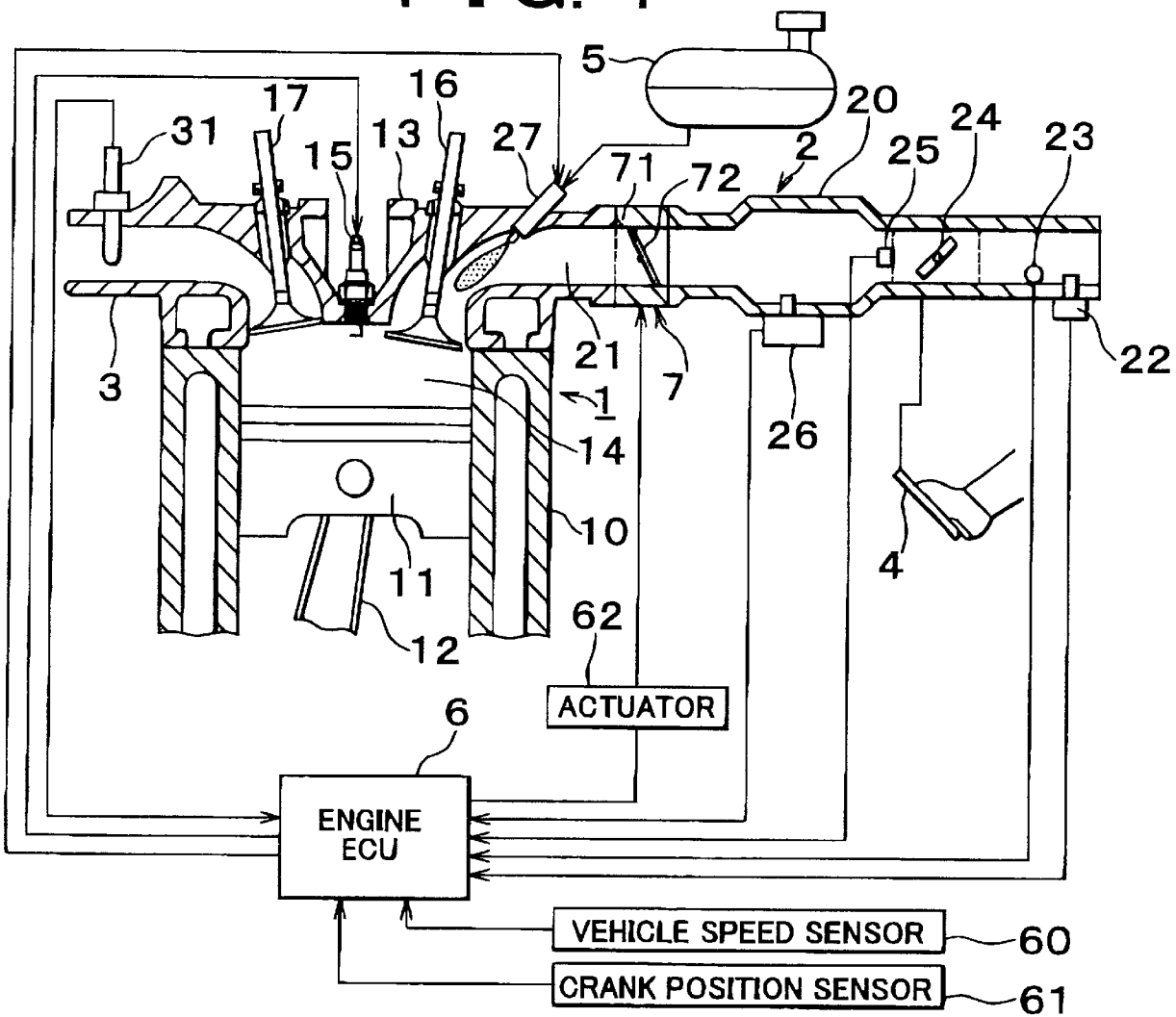
FIG. 1 is a schematic illustration of an exemplary internal combustion engine used with a first embodiment of this invention.

Preferred embodiments of the invention will be described hereinafter with reference to the accompanying drawings. To facilitate the understanding of the description, like components are represented by like reference characters as much as possible, and redundant descriptions will be avoided.

FIG. 1 is a schematic illustration of an internal combustion engine to which a first embodiment of the intake apparatus of an internal combustion engine in accordance with the invention is applied.

An intake pipe 2 and an exhaust pipe 3 are connected to an internal combustion engine 1 that is a spark ignition type multi-cylinder gasoline internal combustion engine. The intake pipe 2 is provided with an intake air temperature sensor 22 for detecting the temperature of intake air, an air flow meter 23 for detecting the amount of intake air, and a throttle valve 24 that cooperates with operation of an accelerator pedal 4. The intake pipe 2 is further provided with a throttle opening sensor 25 for detecting the degree of opening of the throttle valve 24. A surge tank 20 of the intake pipe 2 is provided with an intake pressure sensor 26 for detecting the pressure in the intake pipe 2. An intake port 21 connected to each cylinder of the internal combustion engine 1 is provided with an electromagnetically driven injector (fuel injection device) 27. The injector 27 is supplied with gasoline as a fuel from a fuel tank 5. The internal combustion engine 1 shown in FIG. 1 adopts a multi-point injection system in which injectors 27 are disposed separately for the individual cylinders.

An intake control valve assembly 7 incorporating an intake control valve 72 is mounted between the surge tank 20 and the intake port 21.

A piston 11 is provided for reciprocating movements in vertical directions in FIG. 1 within each cylinder 10 of the internal combustion engine 1. The piston 11 is connected to a crankshaft (not shown) via a connecting rod 12. A combustion chamber 14 is defined by the cylinder 10 and a cylinder head 13 above the piston 11. An ignition plug 15 is positioned in an upper portion of the combustion chamber 14. The combustion chamber 14 is connected to the intake pipe 2 and the exhaust pipe 3 via an intake valve 16 and an exhaust valve 17 that can be opened and closed.

The exhaust pipe 3 is provided with an air-fuel-ratio sensor 31 that outputs an electric signal corresponding to the oxygen concentration in exhaust gas.

An engine ECU 6 (that includes a control device of an intake apparatus of an internal combustion engine in accordance with the invention) for controlling the internal combustion engine 1 is formed mainly by a microcomputer. The ECU 6 accepts input of signals output from the aforementioned sensors (the intake air temperature sensor 22, the air flow meter 23, the throttle opening sensor 25, the intake pressure sensor 26, the air-fuel-ratio sensor 31) as well as a vehicle speed sensor 60 and a crank position sensor 61. The ECU 6 controls the operations of the ignition plug 15, the injector 27, and an actuator 62.

Figure 2:
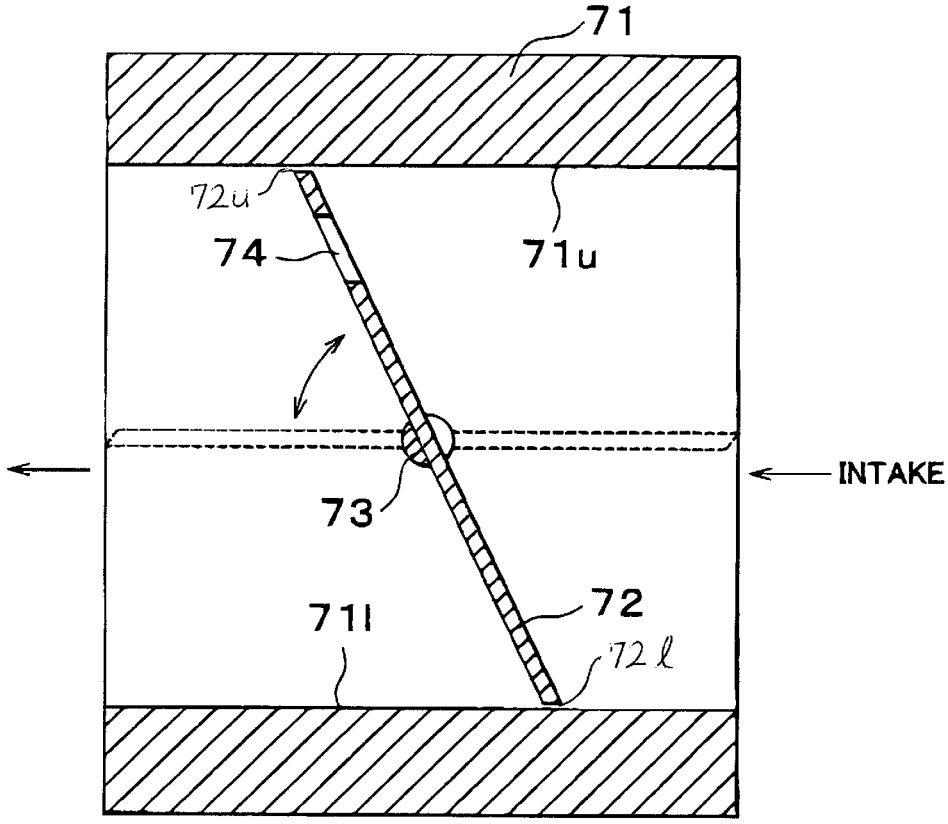
FIG. 2 is a sectional view of an exemplary valve assembly used in accordance with an embodiment of this invention.
Figure 3:
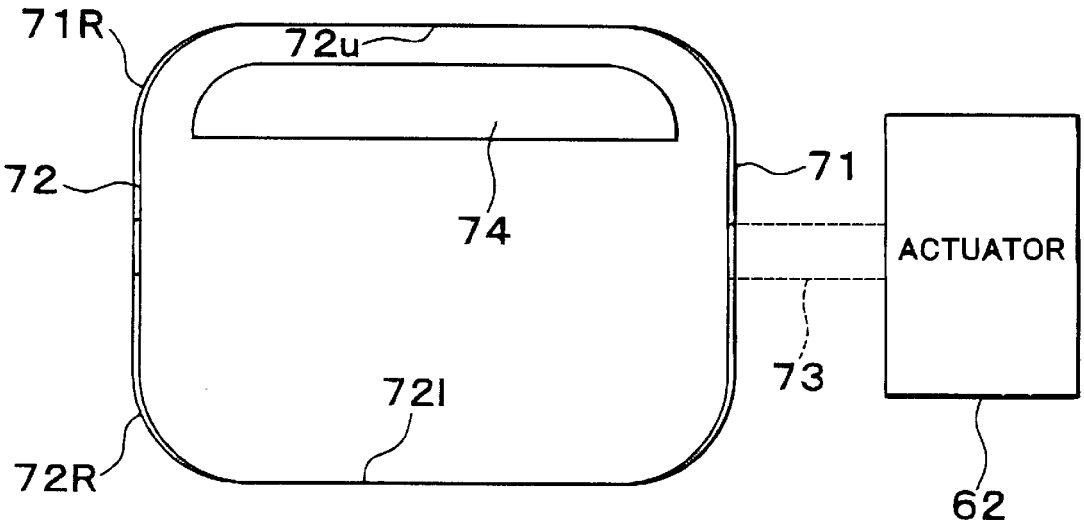
FIG. 3 is another view of the exemplary valve assembly used in accordance with an embodiment of this invention.

FIGS. 2 and 3 are enlarged views illustrating specific structures of the intake control valve assembly 7. FIG. 2 is a sectional view of the valve assembly 7 taken from a side. FIG. 3 is an elevation of a valve assembly 7 portion viewed from the side of the surge tank 20. A section of a pipe portion 71 of the valve assembly 7 has a generally oval shape with four quarter round corner portions 71R. The intake control valve (hereinafter, simply referred to as "valve") 72 is disposed in the pipe so that the valve 72 can be turned about a shaft 73. The valve 72 can be opened and closed by driving the shaft 73 through operation of the actuator 62 connected to the shaft 73.

As for the shape of a valve body of the valve 72, an external shape of the valve substantially conforms to an oblique sectional shape (generally rectangular shape) of the pipe portion 71 of the valve assembly 7 as shown in FIG. 3. That is, the shape of the valve body of the valve 72 has four quarter round corner portions 72R. The shape of the valve body of the valve 72 has in its upper central portion an opening 74 that has an elongated half-moon shape.

The valve 72 is fixed to the shaft 73 after the four quarter corner portions 72R of the valve 72 are brought into contact with the corresponding four corner portions 71R of the pipe portion 71 in a closed posture of the valve 72. This fixing manner makes it possible to attach the valve 72 to the shaft 73 with good precision. As a result, the contact between an upper surface 72*u* or a lower surface 721 of the valve 72 and an upper wall surface 71*u* that is an upper portion of the interior wall of the pipe portion, or a lower wall surface 711 that is a lower portion of the interior wall of the pipe portion, is avoided except when the valve 72 is closed. Therefore, undesired problems can be prevented, such as damage caused by contact of the valve 72 with the upper wall surface 71*u* or the lower wall surface 711, fixation of the valve 72 to the interior wall of the pipe portion caused by the aforementioned contact, etc. Furthermore, it becomes easier to maintain a predetermined range of clearance between the external periphery of the valve 72 and the wall surface of the pipe portion 71.

Figure 4:
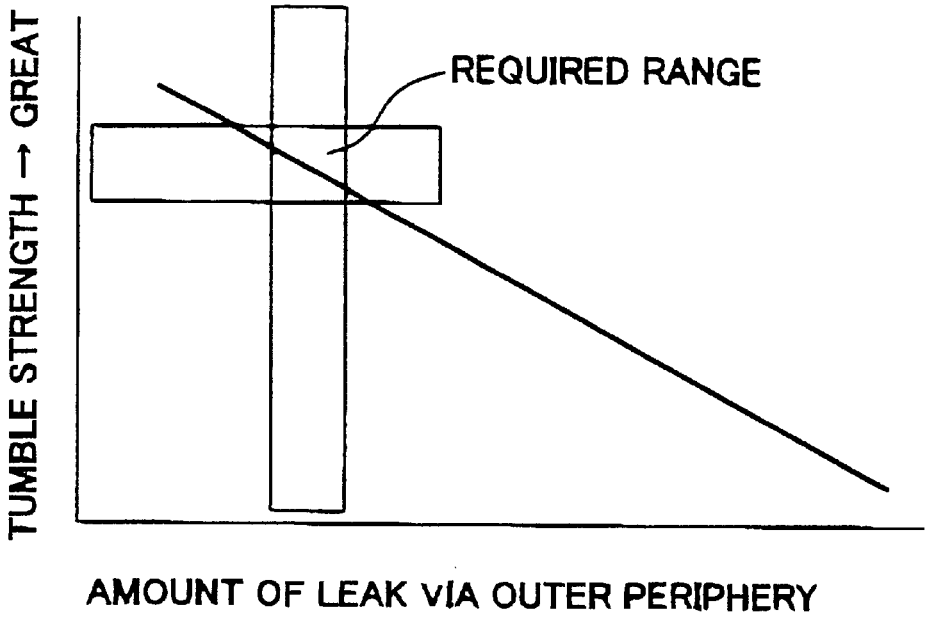
FIG. 4 is a graph showing an exemplary relationship between the amount of air leaking and the tumble strength.
Figure 5:
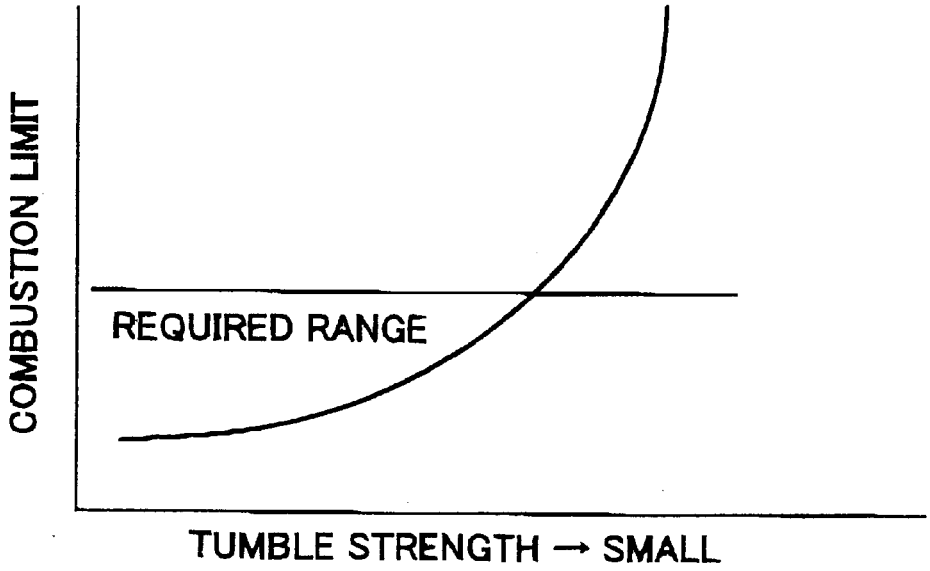
FIG. 5 is a diagram showing an exemplary relationship between the tumble strength and the combustion limit.

A relationship between the amount of leakage that occurs via the outer periphery of the valve and the tumble strength will be described. FIG. 4 is a graph indicating a relationship between the amount of air flow and the tumble strength. FIG. 5 is a diagram indicating a relationship between the tumble strength and the combustion limit (A/F). As shown in FIG. 4, the tumble strength decreases with increases in the amount of outer peripheral leakage. As the tumble strength decreases, the combustion limit shifts toward a higher concentration side, as shown in FIG. 5, so that stable combustion becomes difficult to achieve in a fuel-lean region. Thus, it should be understood that management of the amount of outer peripheral leakage is needed as well as management of the area of the open portion in order to achieve a predetermined tumble strength.

Figure 6:
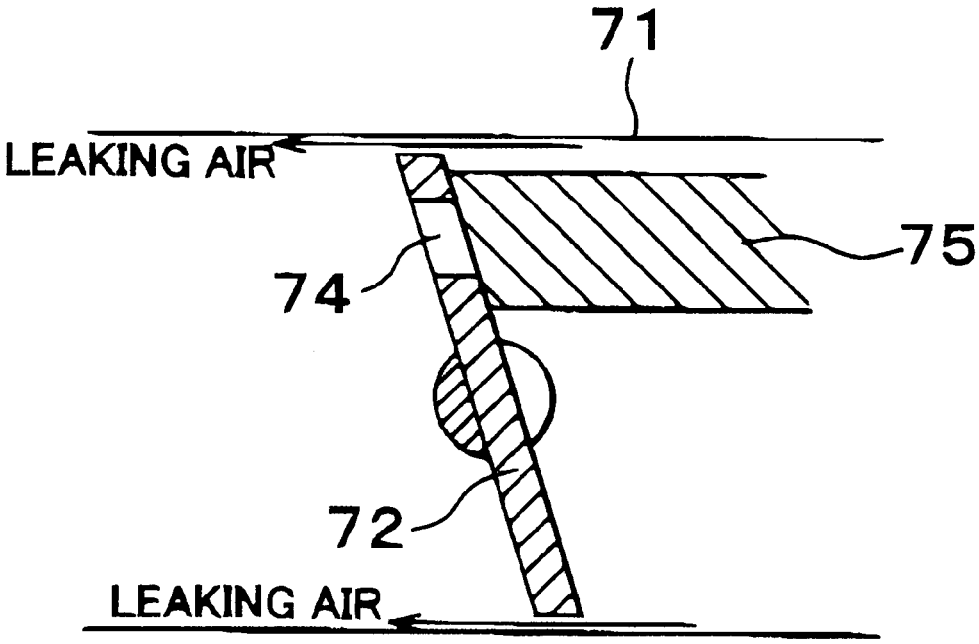
FIG. 6 is a diagram illustrating control of the exemplary valve assembly used in accordance with this invention.

With the valve 72 in this embodiment, the opening 74 is closed through the use of a closing member 75 as shown in FIG. 6, after the valve 72 is mounted in the pipe portion 71. After that, the amount of air leaking through a gap between the outer periphery of the valve 72 and the wall surface of the pipe portion 71 is measured by feeding air through the intake pipe 2. Therefore, by controlling the intake apparatus while factoring in measured values of the amount of air leakage, the amount of intake air can be precisely controlled, so that desired tumble currents can be formed. It should be noted herein that the closing member 75 is removed after measured values of the amount of air leakage are obtained.

Figure 7:
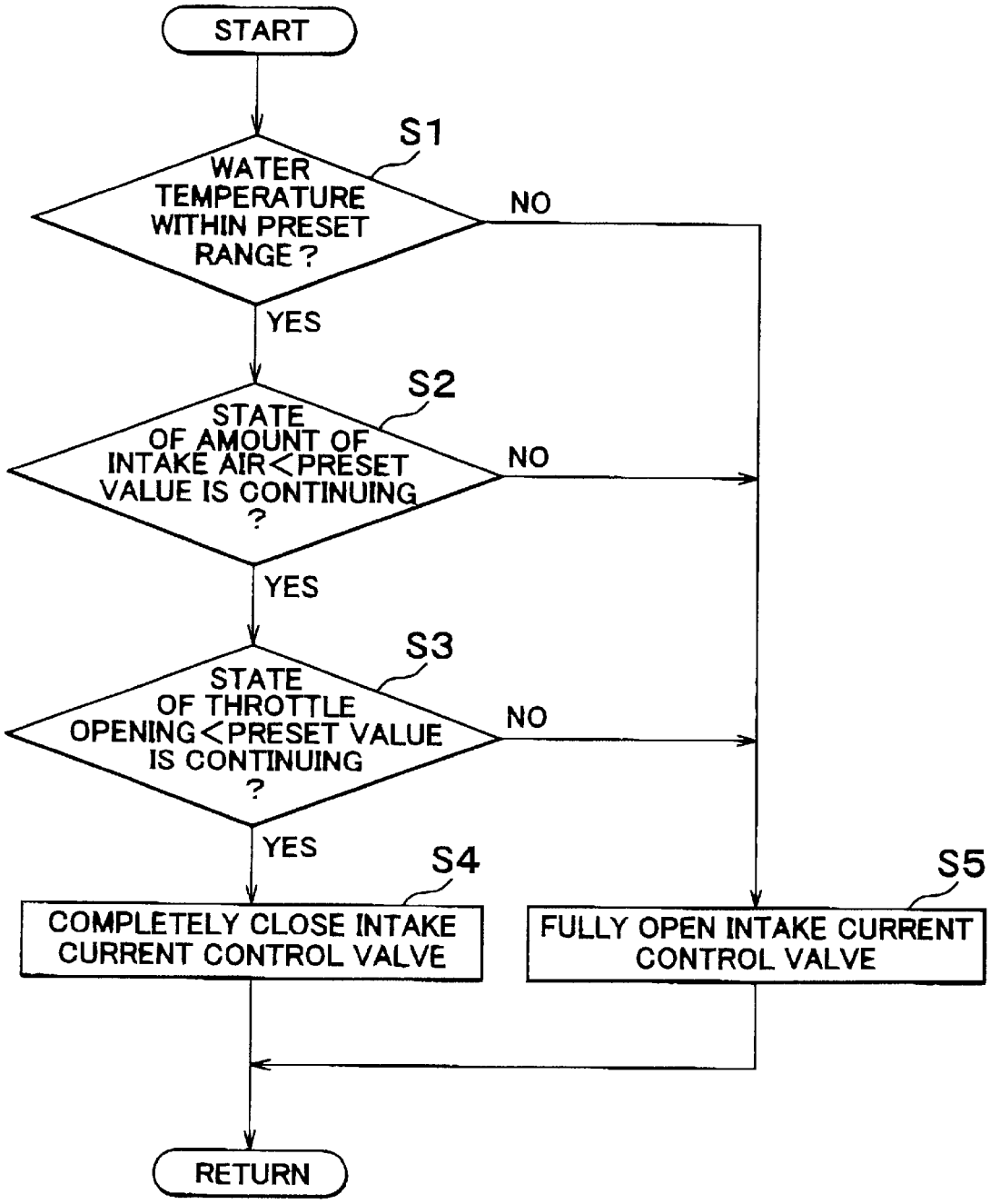
FIG. 7 is a flowchart illustrating an exemplary control operation of the embodiment shown in FIG. 1.

Operation of the intake apparatus of the internal combustion engine in accordance with the invention will next be described. FIG. 7 is a flowchart illustrating a control operation. This control operation is executed by the engine ECU 6 repeatedly at predetermined intervals after the ignition key is turned on.

In step S1, determination is made with regard to the engine cooling water temperature. Specifically, it is determined whether the engine cooling water temperature has not become sufficiently high, that is, whether the engine cooling water temperature is within a predetermined range below a certain temperature. If the engine cooling water temperature is low, the result of the determination is "YES" and the control operation proceeds to step S2. In step S2, it is determined whether the amount of intake air is continually less than a predetermined value. If the amount of intake air is small, then the internal combustion engine 1 is in an idling state, and the control operation proceeds to step S3. In step S3, it is determined whether the degree of throttle opening is continually less than a predetermined value. If the degree of throttle opening is continually less than the predetermined value, then the internal combustion engine 1 is in the idling state, and the control operation proceeds to step S4. In step S4, the intake control valve 72 is completely closed by driving the actuator 62.

When the valve 72 is completely closed, the passage in the valve assembly 7 is partially closed by the valve 72, as shown by a solid line in FIG. 2, so that air flows only through the open portion 74 of the valve 72. As the passage area of the intake pipe is partially closed in this manner, a great negative pressure occurs downstream of the valve 72, and the air current through the open portion 74 is accelerated. Since the amount of air leakage through the gap between the outer periphery of the valve 72 and the interior wall of the pipe portion has been accurately ascertained, as previously described, it is possible to precisely control of the intake apparatus factoring in the amount of air leakage. Therefore, a desired tumble current is formed.

The air current from the open portion 74 is led to the intake port 21. A strong air current along an upper wall surface is formed in the intake port 21, and is led into the combustion chamber 14 via the intake valve 16. As a result, a desired tumble current is formed within the combustion chamber.

With an internal combustion engine that does not have an intake control valve, if the wall surface temperature of the intake port 21 is low, for example, during a first idling state, the negative pressure in the intake pipe is small, so that fuel injected from the injector does not readily evaporate, and an increased amount of deposited fuel on the interior wall of the intake pipe will likely occur. In the internal combustion engine 1 equipped with the intake apparatus in accordance with the embodiment of the invention, however, the negative pressure in the intake pipe 2 can be increased by the intake control valve 72. Therefore, due to a reduced-pressure boiling effect, the evaporation of fuel is accelerated, and the depositing of fuel on the interior wall of the intake pipe 2 can be reduced.

Furthermore, due to the formation of a strong tumble current in the combustion chamber 14, it becomes possible to conduct combustion at a leaner air-fuel ratio (A/F). Therefore, the amount of fuel injected can be reduced, and therefore a realization of a stable idling operation and a reduction in the emission of unburned fuel can be obtained, together along with a retardation of the ignition timing.

If the determination in any one of steps S1 to S3 in FIG. 5 results in "NO", the control operation proceeds to step S5. In step S5, the valve 72 is fully opened by driving the actuator 62, so that a normal operation is performed without the intake current control. If the result of determination in step S1 is "NO", that is, if the engine cooling water temperature is sufficiently high, it is considered that the internal combustion engine 1 not in the first idling state. In that situation, the amount of fuel deposited on the interior wall of the intake pipe 2 is small. Furthermore, the temperature of an exhaust gas control catalyst has also sufficiently risen. Hence, unburned fuel can be appropriately removed, and therefore, the degradation of emissions can be substantially prevented. If the result of the determination in step S2 or S3 is "NO", a driver may be requesting an increase in the amount of intake. However, if the intake control valve 72 is in the completely closed state, the amount of intake cannot be appropriately increased. Therefore, the valve 72 is fully opened in step S5, so as to increase the amount of intake air. As a result, the internal combustion engine 1 can meet the driver's request, and the drivability of the vehicle equipped with the internal combustion engine 1 improves.

As understood from the above description, since the intake pipe 2 has an oval sectional shape with four round corners, and the intake control valve 72 also has four round corners corresponding to the four round corners of the sectional shape of the intake pipe 2, the intake control valve 72 can be accurately positioned by utilizing the curved portions of the four corners. Furthermore, since none of the corner portions has an angled corner portion, the valve is unlikely to contact the interior wall of the intake pipe 2 even if a deviation occurs during the operation of mounting the valve. Thus, valve damages and fixation of the valve can be prevented. Still further, since it is easy to close the open portion of the valve and measure the leakage via the periphery of the valve, the amount of leakage can be reliably controlled.

Furthermore, the adoption of the slit-shaped opening in the intake control valve 72 allows the open portion to be processed with higher precision by press forming or the like, so that the variation in the required opening area during the closed valve state can be reduced and stable combustion can be secured.

Figure 8:
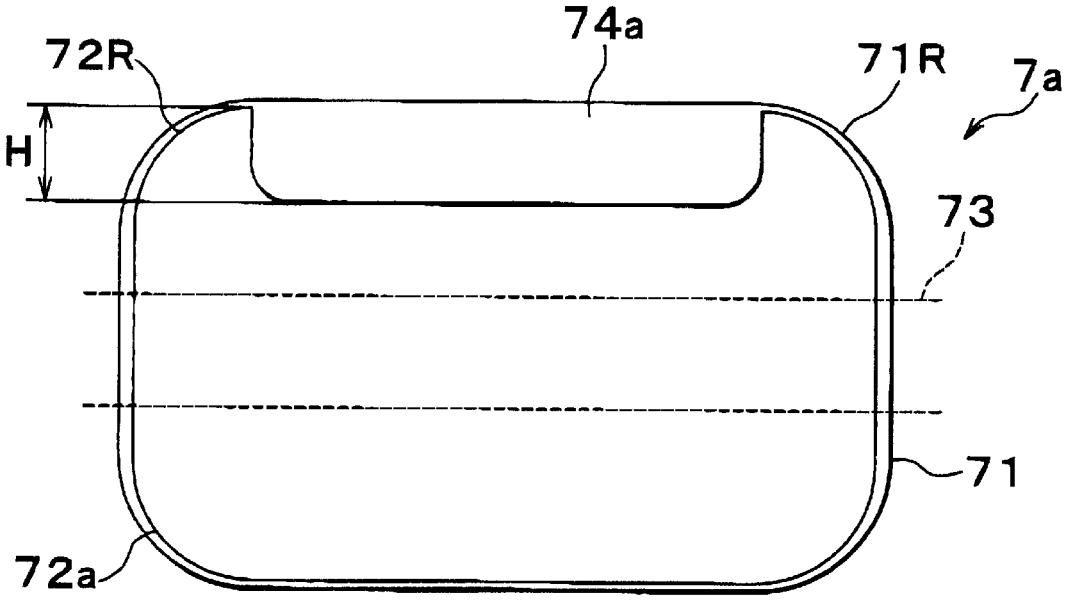
FIG. 8 is a diagram showing an exemplary valve assembly used in a second embodiment according to this invention.

FIG. 8 is a diagram showing a section of a valve assembly 7*a* in a second embodiment of the internal combustion engine intake apparatus in accordance with the invention. In this embodiment, an opening 74*a* of a valve 72*a* is formed by cutting out a portion of the valve 72*a* between two upper corner portions. In this embodiment, too, four quarter round corner portions 72R are formed, so that the precise mounting of the valve is possible through the use of the corner portions 71R, 72R, as with the valve 72 of the first embodiment. Therefore, the valve 72*a* does not contact the pipe wall 71*u* or 711 except during closure of the valve, so that damages to the valve 72*a* and the pipe walls 71*u*, 711 and fixation of the valve can be avoided.

It is preferable that edge lines of the open portion of the valve 72*a* be connected by curves. This configuration avoids an angled corner in the peripheral edge of the open portion, so that the danger of contact between the valve and the intake pipe can be further reduced, and damages to the valve and fixation thereof can be substantially prevented.

Furthermore, it becomes easy to maintain a predetermined range of gap size between the outer periphery of the valve 72*a* and the pipe wall. Therefore, it is easy to set the opening area that includes the area of the gap at a desired value, and to produce a desired tumble strength.

Since the open portion of the valve is a cutout formed along an outer edge between two adjacent corners of the valve, the valve body can be easily formed with high precision by press forming or the like.

Figure 9:
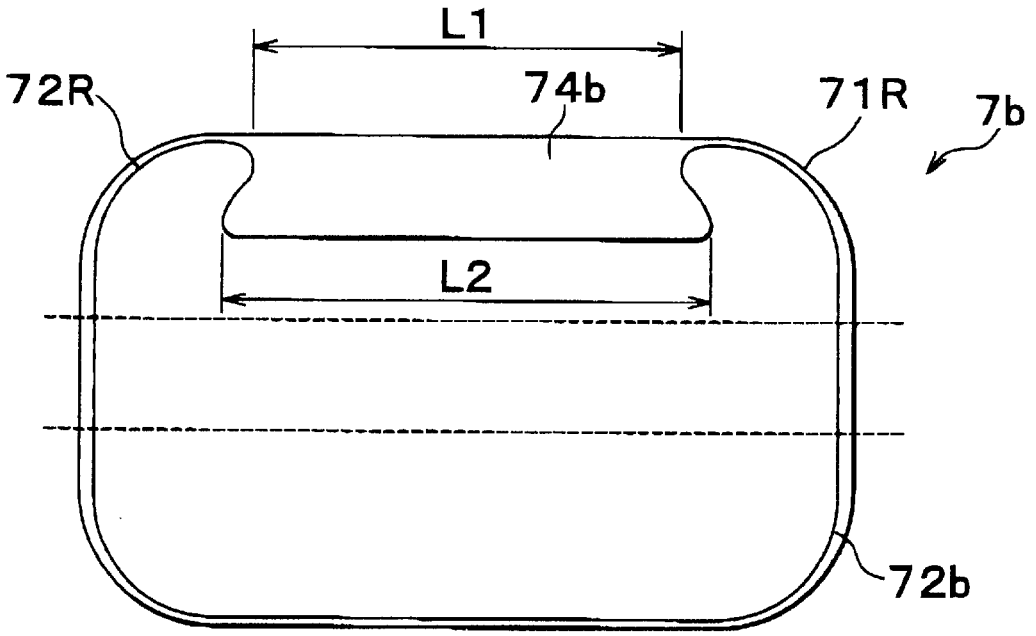
FIG. 9 is a diagram showing an exemplary valve assembly used in a third embodiment according to this invention.
Figure 10:
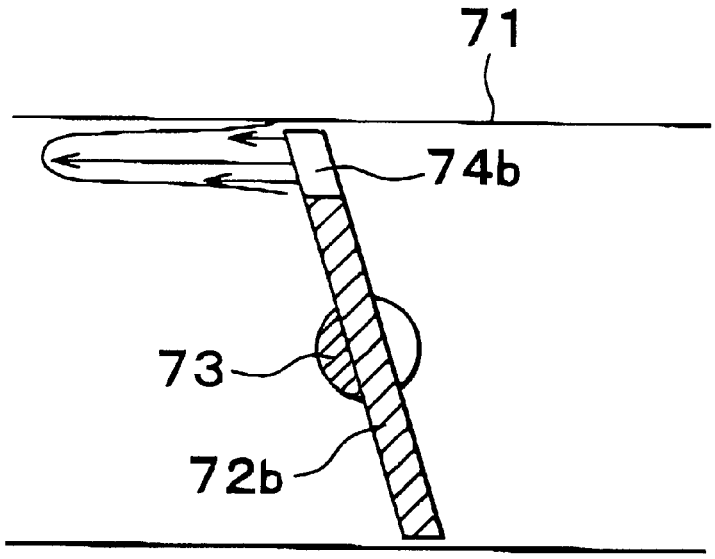
FIG. 10 is a diagram showing an exemplary distribution of flow velocity of air currents formed downstream of the valve in the second embodiment according to this invention.
Figure 11:
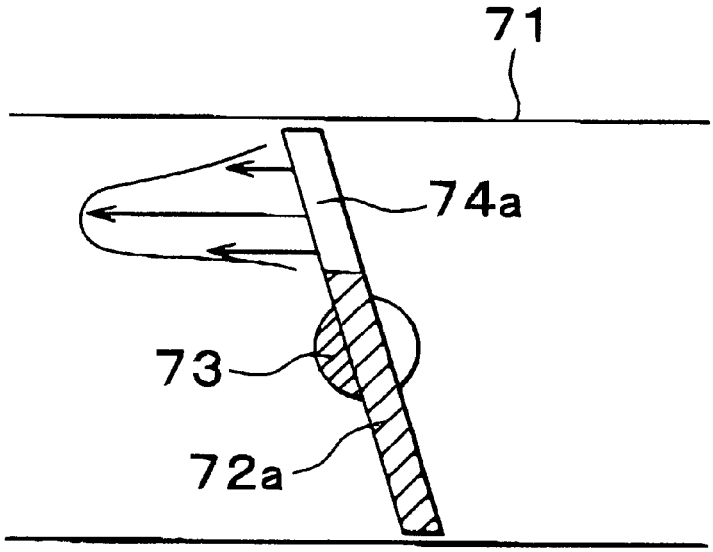
FIG. 11 is a diagram showing an exemplary distribution of flow velocity of air currents formed downstream of the valve in the third embodiment according to this invention.

FIG. 9 is a diagram showing a section of a valve assembly 7*b* in a third embodiment of the internal combustion engine intake apparatus in accordance with the invention. In this embodiment, an opening 74*b* of a valve 72*b* is formed by cutting out a portion of the valve 72*b* between two upper corner portions, as with the second embodiment. Furthermore, a maximum lateral dimension L2 of the opening is set greater than a dimension L1 of the opening along an outer edge, so that the height H of the opening can be reduced from the height of the opening in the second embodiment while the same opening area is maintained. As a result, the velocity of flow downstream of the valve is greater at the site of the dimension L2 than at the site of the smaller dimension L1 during closure of the valve. The distribution of downstream flow velocity is indicated in FIG. 10. In the third embodiment, the velocity of flow adjacent to an upper surface of the interior wall of the intake pipe 2 can be increased and a stronger tumble current can be formed, in comparison with the second embodiment shown in FIG. 11.

Although in the foregoing embodiments, the intake pipe 2 has a section shape with four quarter-circular corner portions, the intake pipe 2 may have a sectional shape with four quarter-elliptical corner portions. Furthermore, it is also possible to dispose an intake control valve 72 in an intake pipe body instead of employing the valve assembly.

In the illustrated embodiments, the controller is implemented with a general purpose processor. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to what are preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An intake apparatus of an internal combustion engine, comprising:

an intake pipe that leads an intake air current into a combustion chamber, and whose corner portions of a cross-sectional form in a longitudinal axis thereof are formed by curves; and an intake control valve that is disposed upstream of the combustion chamber, that controls the intake air current to the combustion chamber by changing between an opening-state and a closing-state thereof and that has an open portion for passing the intake air current which passes only through the open portion in the closing-state, and has an external shape that corresponds to all the corner portions of the cross-sectional form of the intake pipe.

2. The intake apparatus according to claim 1, wherein the intake pipe has a generally oval sectional shape with at least four curved corner portions.

3. The intake apparatus according to claim 2, wherein the curved corner portions are arcs of a quarter sector of a circle.

4. The intake apparatus according to claim 2, wherein the curved corner portions are arcs of a quarter sector of an ellipse.

5. The intake apparatus according to claim 1, wherein the intake apparatus is disposed downstream of a throttle valve in the intake pipe.

6. The intake apparatus according to claim 1, wherein the open portion includes a hole formed in the intake control valve.

7. The intake apparatus according to claim 6, wherein the hole is located near an upper edge of the intake control valve.

8. The intake apparatus according to claim 7, wherein the hole is a slit shape.

9. The intake apparatus according to claim 1, wherein the open portion includes a cutout formed in an edge portion of the intake control valve.

10. The intake apparatus according to claim 9, wherein the open portion is formed in an upper edge portion of the intake control valve.

11. The intake apparatus according to claim 9, wherein the open portion is formed by cutting out an outer edge portion of the intake control valve between two adjacent corner portions.

12. The intake apparatus according to claim 9, wherein an end of the open portion is formed by curves.

13. The intake apparatus according to claim 9, wherein a distance of a mouth of the open portion is set less than a maximum distance of a part of the open portion that is inward of the mouth.

14. A method of operating an intake apparatus of an internal combustion engine, comprising:

intaking air into a combustion chamber through an intake control valve that is disposed upstream of the combustion chamber, the intake control valve having an open portion for passing an intake air current only through the open portion in the closed state and at least four corner portions that correspond in shape to an intake pipe so that the intake air current can be controlled through an opening and closing of the intake control valve.

15. The method of operating the intake apparatus according to claim 14, wherein the open portion includes a hole formed in the intake control valve.

16. The method of operating the intake apparatus according to claim 15, wherein the open portion is located near an upper edge of the intake control valve.

17. The method of operating the intake apparatus according to claim 15, wherein the hole is a slit shape.

18. The method of operating the intake apparatus according to claim 14, wherein the open portion includes a cutout formed in an edge portion of the intake control valve.

19. The method of operating the intake apparatus according to claim 18, wherein the open portion is formed in an upper edge portion of the intake control valve.

20. The method of operating the intake apparatus according to claim 18, wherein the open portion is formed between two adjacent corner portions of the intake control valve.

21. The method of operating the intake apparatus according to claim 18, wherein an end of the open portion is formed by curves.

22. The method of operating the intake apparatus according to claim 18, wherein a distance of a mouth of the open portion is set less than a maximum distance of a part of the open portion that is inwardly of the mouth.

* * * * *